United States Patent [19]

Gorcey

[11] 4,179,984

[45] Dec. 25, 1979

[54] SLIDE MOUNTING WORK STATION

[76] Inventor: Raymond A. Gorcey, 131 Dean St., Hicksville, N.Y. 11801

[21] Appl. No.: 939,662

[22] Filed: Sep. 5, 1978

[51] Int. Cl.[2] ..... F23J 11/00

[52] U.S. Cl. ..... 98/115 LH; 422/104

[58] Field of Search ..... 98/115 R, 115 LH, 36; 422/104; 126/299 R; 55/DIG. 18

[56] References Cited

U.S. PATENT DOCUMENTS

| | | | |
|---|---|---|---|
| 2,292,665 | 8/1942 | Schneible | 98/115 R |
| 3,376,583 | 4/1968 | Frey | 98/115 R |
| 3,537,442 | 11/1970 | Berger | 126/299 R |
| 3,665,917 | 5/1972 | Jensen | 98/115 LH |

*Primary Examiner*—Ronald C. Capossela

*Attorney, Agent, or Firm*—Bauer & Amer

[57] ABSTRACT

A slide mounting work station in which the user performs slide mounting procedures by being permitted to insert only the hands and arms into a work area that is cleansed of toxic fumes by a negative pressure applied through the base thereof while the user is prevented from contact with the fumes by a protective cover through which the procedures are viewed.

14 Claims, 3 Drawing Figures

SLIDE MOUNTING WORK STATION

BACKGROUND OF THE INVENTION

The present invention relates to slide mounting work stations and apparatuses having a substantially enclosed work space and an access opening thereto.

In the performance of microscopic evaluation and diagnosis of human and animal fluids and tissues, fluid and tissue samples or specimens are treated with a variety of reagents prior to mounting or cover slipping of the samples on glass slides or the like. Many of the chemicals or reagents utilized, such as xylene, are volatile and toxic and have associated with them noxious and possibly carcinogenic fumes and odors. It is, therefore, necessary to protect the health of technicians or workers who perform the slide mounting operations from the harmful effects of these fumes.

A common response to the problem has been the installation of a ceiling mounted fume hood over the working area for the purpose of drawing fumes upwardly into the hood and out of the laboratory. A major drawback of conventional fume hoods, however, is that the air flow direction is vertically upward from the work surface so that the unit tends to pull the toxic fumes past the technician's face, resulting in the inspiration of fumes of the possibly carcinogenic reagents prior to exhaustion of the same out of the laboratory. In addition, the unit must draw room air through it at an excessively high flow rate in order to effectively reduce the concentration of toxic fumes in the work area. The use of such high air flow rates is extremely inefficient from an energy conservation standpoint since the heated or air conditioned room air must be constantly replenished to compensate for that exhausted with the fumes through the fume hood. Furthermore, even with the high air flow rates utilized by these units, significant concentrations of toxic fumes remain in the working environment because the fumes of a number of the reagents utilized are heavier than air and, therefore, tend to fall rather than to rise into the fume hood.

In response to these drawbacks, various work stations have been developed with the object of permitting the operator to insert his hands or instruments through an access opening into the interior of a defined work space while at the same time substantially preventing contamination of the ambient atmosphere by fumes within the enclosed work space. However, prior art units presently known circulate air in and through the device with the result that disturbing or eddy currents often form within the enclosure and at the entrance to it. To minimize the development of eddy currents, a relatively high air flow rate is utilized. The movement of air at such high rates is extremely disrupting in the performance of slide mounting procedures and results in a rapid drying of the tissue samples and of the reagents utilized to maintain the same in a moist condition. This high rate of air flow must be avoided because once the tissues dry, they become opaque and, therefore, unusable for microscopic evaluation.

As a consequence, the present invention seeks to provide a substantially enclosed work space or area and an access opening thereto such that a user may perform slide mounting procedures therein without contaminating the user or the ambient atmosphere about the apparatus with toxic fumes present or generated within the work space.

It is another object of the present invention to provide a slide mounting work station wherein only limited portions of the user's body are permitted to enter into the work space while the remainder of the user's body is isolated and protected from toxic fumes within the interior of the work station.

It is a further object of the present invention to provide a slide mounting work station wherein the withdrawal of toxic fumes from the enclosed work space is performed without causing the development of disturbing eddy currents therein.

It is still another object of the present invention to provide for the withdrawal of toxic fumes from the work space while bathing the portions of the user's body inserted into the work space in clean room air so as to prevent such inserted body portions from being attacked by the toxic fumes without producing disturbing eddy currents.

Further objects, features and advantages of the present invention will be more fully appreciated by reference to the following detailed description of a presently preferred, but nonetheless illustrative embodiment in accordance with the present invention when taken in conjunction with the accompanying drawings, wherein.

DETAILED DESCRIPTION OF THE PREFERRED EMBODIMENT

The present invention is directed to a work station within which human or animal tissue specimens may be cover slipped or mounted on glass slides for microscopic evaluation and diagnosis. In preparing the tissue specimens or samples for mounting, the same are initially sequentially treated with a variety of reagents, including xylene, for the purpose of rendering the specimens more easily examined under a microscope and to prevent them from drying out, and thereby becoming unsuitably opaque, prior to viewing.

The reagents utilized in these procedures produce toxic and possibly carcinogenic fumes harmful to the technician. The present invention, therefore, provides a substantially enclosed work space having a restricted access opening through which the technician may insert his hands and arms for manipulating and performing functions on the tissue specimens and the slides in the work space. Since the reagent-treated specimens tend to dry out quickly, it is important to minimize the air flow thereabout so as not to inordinately increase the speed with which they dry.

In addition, the slide mounting procedures are easily disturbed and upset by eddy currents which tend to form as air flows about obstructions and within enclosed areas and, as a consequence, it is desirable to minimize the development of disturbing eddy currents in or about the work space. Accordingly, the present invention is constructed to provide for the efficient and effective removal of toxic fumes from the work area utilizing a relatively low air flow rate while substantially eliminating or minimizing the formation of disturbing eddy currents.

Figure 1:
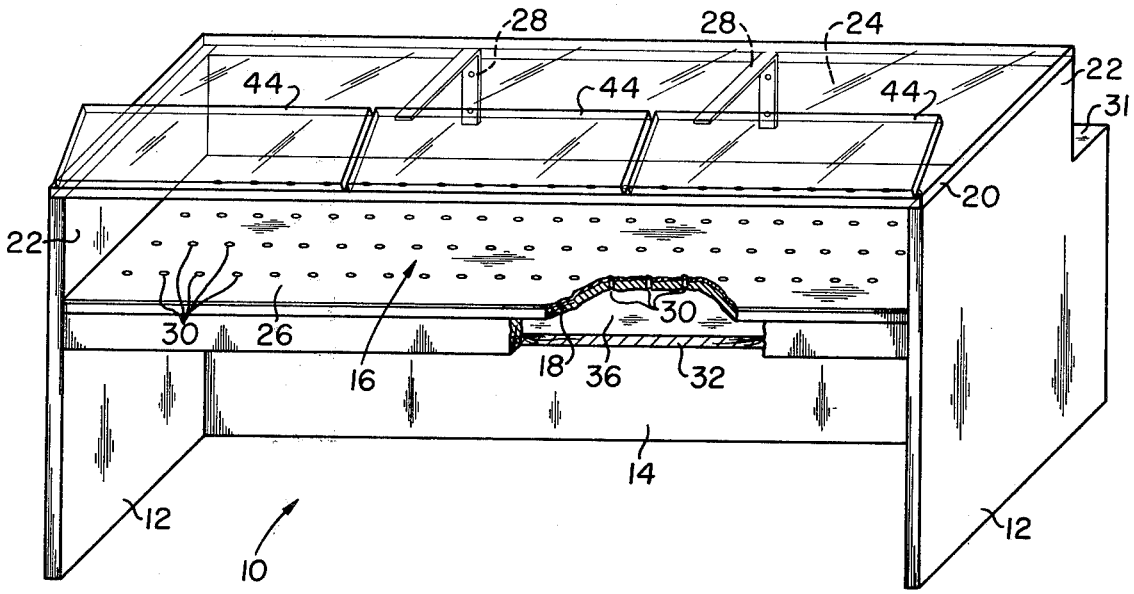
FIG. 1 is a front perspective view of a slide mounting station according to the invention.

Turning now to the drawing, there is shown in FIG. 1 a slide mounting work station, designated by the general reference numeral 10, constructed in accordance with the teachings of the present invention. The work station 10 is seen to include side supports 12 and a back wall 14 for supporting and defining a work area within which slide mounting procedures are performed at a suitable working height above the laboratory or room floor.

The work space or area, generally designated 16, is bounded by the supporting structure of the sides and back walls 12, 14 respectively and is shown by way of example as generally rectangular in shape. The work area 16 is bounded by a substantially horizontally disposed base work surface 18 upon which slide mounting materials may be supported and the related functions performed while a protective cover member 20 is spaced a selected height above the surface 18 and defines the top of the work area enclosure or space 16.

A pair of oppositely disposed sides 22 and a rear wall 24, that may be vertical extensions of 12 and 14, connect the work surface 18 and cover 20 in a selected spaced relationship about the peripheries thereof to enclose the work area 16 on three sides thereof. The fourth side of the work area is open and defines an access opening 26 bounded and limited by the work surface 18 which limits the bottom height of the opening 26 and by the cover 20 limiting the upper height of the access opening 26. Accordingly, the selected relative spacing between the work surface 18 and cover 20 determines the vertical height of the access opening 26.

The cover member 20 is preferably clear or transparent so as to enable the technician to easily view the substantially enclosed work area 16 within which slide mounting operations and procedures are performed. For this purpose, the cover 20 may comprise a sheet or pane of glass, or the same may be formed of clear plastic, as plexiglass or the like, which is highly resistant to chemical attack or inadvertent or accidental breakage. Additional support for the cover member 20 intermediate the sides 22 may be effected by the provision of brackets 28 carried on the rear wall 24.

The work surface 18 is provided with a plurality of pores or passages 30 defined in and extending through the same. For reasons that will become clear as this description proceeds, it is preferred that the passages 30 be distributed over substantially the full extent of the work surface 18 beginning immediately adjacent the access opening 26. The porous or foraminous work surface 18 may be formed with a top face of inert material, as mica, for the purpose of inhibiting corrosion of the surface by reagents accidentally spilled or otherwise coming in contact therewith.

The work station 10 is provided with a table top extension 31 of the work surface 18 at the back thereof beyond the rear wall 24 and external to the work area 16. As perhaps best seen in FIG. 2, a solid imperforate bottom wall 32 is spaced downwardly beneath and coextensive with the underside of the work surface 18 and with the extension 31. Side walls 12 and rear border 34 define between the work surface 18 and bottom wall 32 a substantially hollow chamber 36. Referring to FIG. 3, the chamber 36 is conveniently divided into a plurality of separate compartments 37 beneath the surface 18. As will be fully understood hereinafter, the inclusion of separate compartments 37 enables a more even and selective evacuation of toxic fumes from the work area 16 during operation and use of the work station 10. However, it should be clear that the chamber 36 need not be divided and could also be formed as a single compartment within the teaching of the invention and the use of a single compartment is contemplated and deemed to be consistent with the disclosure.

The chamber 36 communicates simultaneously with the work space or area 16 through the pores or passages 30 in the work surface 18 which also forms the bottom of the work area 16 and the top of the chamber 36. At least a portion of the chamber 36 is seen to extend rearwardly beyond the rear wall 24 bounding the back of the work space 16 and below the extension 31.

An opening 38 at the rear of each compartment 37 of the chamber 36 is connected with an exhaust port or conduit 40. It can accordingly be appreciated that the exhaust conduit 40 communicates with the work space or area 16 through the chamber 36 and the passages 30 of the work enclosure area 16.

In use, a technician or other user of the work station 10, by reason of the selected height limitation of the access opening 26, may insert portions of only his arms and hands into the work area 16. Slide mounting operations, functions and manipulations may thus be performed within the work area 16 utilizing toxic reagents while the user views such operations through the clear or transparent cover member 20 which simultaneously serves to protect his upper body from and prevents the same from contact with the toxic fumes emitted by the reagents. The spacing between the work surface 18 and cover member 20 is selected to prevent the user from inserting any more than portions of his forearms and hands into the work area 16 while at the same time providing a sufficiently long (widthwise) access opening 26 to enable him to move along the length of the work area 16 while performing the slide mounting procedures.

The exhaust port or conduit 40 is connected with a source of vacuum or suction for the purpose of applying a negative or less than atmospheric pressure in and to the chamber 36. This negative pressure or suction is directed from the chamber 36 to the work area 16 through the passages 30 in the work surface 18. Those skilled in the art will readily recognize that this results in a direct downward, undisturbed flow of air from the area 16 into the chamber 36 therebelow. This produces a consequent inwardly directed flow of air into the work area 16 through the access opening 26 from the room in which the work station 10 is located. This inwardly directed air flow is represented by the arrows 50 in FIG. 2.

In this manner, clean room air drawn into the work area 16 from the laboratory or room in which the work station 10 is located creates an inwardly directed draft flowing about and cleansing the arms and hands of the user and which mixes with the toxic fumes present in the work area 16 so as to dilute the harmful effects of the same on the user. As a consequence, the user's inserted limbs are bathed in clean room air as they perform the slide mounting operations and procedures so as to prevent attack thereon by the toxic fumes in the work area.

The clean room air is pulled into the work area 16 past and about the user's inserted hands and arms and downwardly through the passages 30 into the chamber 36. The air carries with it toxic fumes admixed therewith in the work area 16 and the mixture is exhausted directly from the work station 10 by way of the conduit 40. Thus, the direction of air flow is always inward from the room in which the work station 10 is located into the work area 16 and as a consequence the possibility of leakage or escape into the room of toxic fumes from the work area is obviated. In addition, the provision of passages 30 in the work surface 18 immediately adjacent the access opening 26 acts as a barrier to the escape of fumes by capturing for exhaustion from the work station 10 fumes proximate the forward edge of the work area 16. Eddy currents are avoided at the access opening 26 because there is no circular or counter flow, but only a downward flow of air from the area 16 to the chamber 36 directly therebelow.

Figure 2:
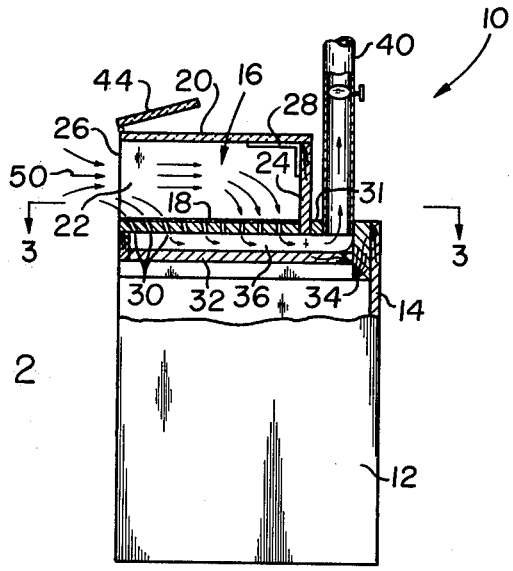
FIG. 2 is a side view with portions thereof cutaway.
Figure 3:
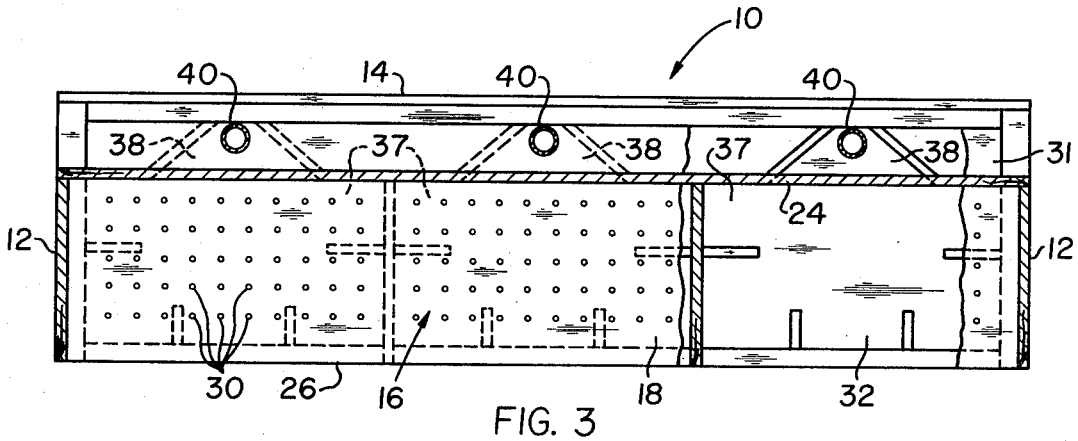
FIG. 3 is a cross-section of FIG. 2 taken in the direction of lines 3—3.

As seen in FIG. 2 at least some of the passages 30 defined in the work surface 18 may be angled or slanted toward the access opening 26 for the purpose of facilitating the movement of clean room air into and through the work area 16. In particular, angling of the passages 30 closest to the access opening 26 will further avoid the formation of eddy currents in the work area 16 by advantageously steering the inwardly directed draft of clean air directly into the passages 30. As the clean air draft passes deeper into and through the work area 16, protectively bathing the user's inserted hands and arms, it picks up toxic forms which intermix therewith and are thus carried directly out of the work area by way of the passages 30.

As a consequence, the steering or direction of the clean air draft prevents the formation of turbulence on eddy currents within the work area 16 as the inwardly directed draft of room air contacts fumes contained in the work area since this contact does not alter the directed air flow or draft but merely carries the fumes along therewith through the passages 30. The angle at which the particular passages 30 are slanted toward the access opening 26 may be gradually varied relative to their distance therefrom such that the passages 30 closest to the opening 26 are provided at a more extreme angle or slant than those further from the access opening.

The preferred advantageous distribution of the passages 30 substantially throughout the full extent of the work surface 18, and the further provision of passages 30 immediately adjacent the access opening 26, effectively eliminates "dead spots" within the work area 16 and minimizes the formation of air disturbances or eddy currents within the work area 16. Accordingly, although clean room air is constantly being drawn into the work area 16 through the access opening 26 to bathe and cleanse the opening with room air that flows downwardly through the passages 30 into the chamber 36 to be exhausted by way of the exhaust conduit 40, the distribution of passages 30 substantially throughout the work surface 18 renders this air flow substantially uniform and simultaneous throughout the work area 16. Slide mounting procedures may, therefore, be easily carried out within the work area without the disturbing and disrupting influence of unexpected interfering eddy currents.

An additional advantage attained from the disclosed construction of the work station 10 and in particular from the distribution of passages 30 along the work surface 18 is the ability to efficiently and effectively withdraw toxic fumes from within the work area 16 utilizing a relatively low air flow rate. While prior art devices and those currently in use generally require air flow rates of at least 100 feet per minute, resulting in an accelerated drying out of tissue specimens and reagents, it is preferred that air flow rates of less than 100 feet per minute be utilized with the slide mounting work station 10 of the present invention. The use of reduced rates of air flow has the further advantage of decreasing significantly the volume of artificially heated or cooled air that must be replaced as the room air is drawn into the work station during its use and exhausted therefrom.

The work station 10 may be further provided with a series of pivotally movable doors or front covers 44 hingedly connected to the cover member 20 as seen in FIG. 2 for the purpose of closing selected portions of the access opening 26. Thus, when it is desired to utilize only a selected widthwise portion of the work area 16, the doors 44 may be pivotally moved so as to close the unused portions of the access opening 26 and the rate of air withdrawal from the room may be controlled and reduced. In this manner the slide mounting operations may be performed in air flowing at a still further reduced rate and the cost of operating the work station 10 correspondingly reduced.

There has been disclosed a slide mounting work station that operates with unusual efficiency and that is particularly simple to construct. The structural arrangement of the work station 10 provides a substantially enclosed work area or space having an access opening thereto of selected limited height permitting the insertion into the work area of only limited portions, as the hands and arms, of a user's body. At the same time, the remainder or non-inserted body portions of the user are protected from coming into contact with harmful fumes contained within the work space by a cover that permits full view of the procedures within the area 16. The access opening is configured to limit entry to the user's hands and arms while being large enough to permit the user to perform sequential slide mounting operations in various places along the length (widthwise) of the work station 10. Unrestricted viewing of the interior of the work area is provided throughout the extent of the same.

A particularly advantageous feature of the work station 10 is the manner in which toxic fumes are removed from the work space such that a draft of clean room air bathes the user's inserted hands and arms so as to prevent chemical attack thereon by the toxic fumes. The downdraft exhaust of the fumes and of the room air drawn into the work area is accomplished at relatively low air flow rates and without causing the formation of significant disturbing eddy currents which could disrupt and interfere with slide mounting and cover slipping procedures carried on in the work area. Because clean air continually flows into the work area through the access opening, a barrier is effectively formed at the opening to prevent the escape of toxic fumes from the work area into the laboratory or room within which the work station is located. Thus, the work station 10 of the present invention efficiently eliminates toxic fumes within its work area utilizing low air flow rates and substantially without the formation of eddy currents while preventing leakage or escape of the fumes through the access opening into the room environment.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In an apparatus for use in carrying out slide mounting operations utilizing at least a substance producing toxic fumes, a substantially horizontally disposed work surface, wall means upstanding from said work surface about the periphery thereof, cover means supportedly disposed on said wall means and spaced from said work surface to define a slide mounting work enclosure area bound by said work surface and cover means and by said wall means peripherally connecting and separating the same, a chamber disposed beneath at least a portion of said work surface and connected with a source of negative pressure for applying a vacuum to said chamber, a plurality of holes defined in and through said work surface and communicating with said chamber and the negative pressure applied thereto to enable withdrawal through said plural openings of toxic fumes present in said work enclosure area for removing therefrom and cleansing the environment therein of the toxic fumes, and an opening defined in said upstanding wall means between said work surface and spaced cover means for providing such limited access into said work enclosure area that only a user's hands and arms are permitted to enter into the work enclosure area thereby protecting the user's vulnerable upper body sensory portions from the toxic fumes within the work enclosure area by the interposition of said cover means between the toxic fumes and the upper body portions of the user.

2. In an apparatus according to claim 1, said cover means being transparent so as to enable the user to view from above the interior of said work enclosure area during the performance of slide mounting operations therein while protecting the user's sensory body portions from toxic fumes in said work enclosure.

3. In an apparatus according to claim 1, said plural holes being defined substantially along and throughout the extent of said work surface to enable the simultaneous withdrawal of toxic fumes from and throughout the work enclosure area.

4. In an apparatus according to claim 1, said work surface defining the upper bounds of said chamber such that the same is positioned contiguous with and adjacent to said work enclosure area.

5. A slide mounting apparatus comprising:

a work area having a restricted access opening of selected height to permit only the hands and arms of a user therethrough for manipulation and the performance of work within said work area, a cover over said work area permitting the user to see down into said work area and defining the top thereof and limiting the upper height of said access opening, a base spaced down from said cover defining a work surface of said work area and limiting the bottom height of said access opening, side and rear walls enclosing respective side and rear portions of said work area and defining the space between said cover and base, means to create a suction in said work area to withdraw air and toxic fumes therefrom and through said restricted access opening so as to constantly draw into said work area a restricted amount of air through said access opening of selected height from the room in which said apparatus is located to prevent toxic fumes in said work area from exiting from the work area into the room and to assure its removal directly from the work area, and passages in at least a portion of said base to direct the withdrawal of the toxic fumes and room air through said base and out of said work area.

6. A slide mounting apparatus according to claim 5, wherein at least some of said passages are defined in said base adjacent said access opening to prevent toxic fumes in said work area and proximate said access opening from exiting from the work area into the room in which said apparatus is located.

7. A slide mounting apparatus according to claim 5, wherein said passages are defined substantially throughout the extent of said base to enable substantially uniform and simultaneous withdrawal of air and toxic fumes from said work area to avoid the formation of eddy currents within the work area.

8. In an apparatus according to claim 5, said means comprising a chamber communicating with said work area through said passages defined in said base and connected with a source of suction for applying a negative pressure in the chamber to effect withdrawal of air and toxic fumes from said work area through said base passages.

9. An apparatus according to claim 8, wherein said chamber is disposed substantially below said work area and contiguous therewith.

10. An apparatus according to claim 5, and a plurality of door means on said apparatus selectively operable to open and close selected portions of said access opening.

11. An apparatus according to claim 5, wherein the withdrawal of air and toxic fumes from said work area by said suction creating means is preferably performed at a rate of less than 100 feet per minute.

12. An apparatus according to claim 5, wherein said cover covers the whole of said work area and defines a barrier to toxic fumes within said work area to prevent the same from rising out of the work area and into contact with the user's body portions external of said work area.

13. An apparatus according to claim 5, wherein at least some of said passages are angled toward said access opening such that clean air drawn into said work area from the room in which said apparatus is located creates a draft into and within said work area and about the user's inserted arms and hands to bathe the same in the clean room air so as to prevent attack of the user's inserted arms and hands by the toxic fumes without producing disturbing eddy currents.

14. An apparatus according to claim 5, said cover being substantially transparent and defining, a protection guard for preventing body portions other than the inserted arms and hands of the user from coming into physical contact with toxic fumes contained within the work area, the relative spacing between said base and cover being selected to prevent entry of any more than portions of the arms and hands of the user into said work area.

* * * * *